United States Patent [19]

Liu

[11] 3,949,716

[45] Apr. 13, 1976

[54] SPEED LIMITING GOVERNOR FOR INTERNAL COMBUSTION ENGINE

[75] Inventor: Li-Hsiung Liu, Stamford, Conn.

[73] Assignee: Textron, Inc., Providence, R.I.

[22] Filed: Apr. 18, 1974

[21] Appl. No.: 462,180

[52] U.S. Cl. ..... 123/97 R; 123/108; 123/103 R; 137/525.3

[51] Int. Cl.[2] ..... F02D 11/08; F02D 9/02

[58] Field of Search ..... 123/73 R, 73 V, 73 AV, 123/108, 103 B, 97 R, 103 R, 101, 103 D, 98, 198 D, 198 DB; 261/DIG. 48, DIG. 68; 137/525.3

[56] References Cited

UNITED STATES PATENTS

| | | | |
|---|---|---|---|
| 939,549 | 11/1909 | Reineking | 137/525.3 |
| 1,346,521 | 7/1920 | Young | 137/484 |
| 1,624,093 | 4/1927 | Davis | 137/57 |
| 2,689,552 | 9/1954 | Kiekhaefer | 123/73 V |
| 2,739,581 | 3/1956 | Garrett | 123/103 R |
| 3,200,838 | 8/1965 | Sheaffer | 137/525.3 X |
| 3,506,247 | 4/1970 | Hanson et al. | 261/DIG. 68 |
| 3,802,401 | 4/1974 | Nutten et al. | 123/109 X |

*Primary Examiner*—Charles J. Myhre
*Assistant Examiner*—William C. Anderson
*Attorney, Agent, or Firm*—Robert E. Burns; Emmanuel J. Lobato; Bruce L. Adams

[57] ABSTRACT

A speed governor for an internal combustion engine comprises a flexible reed having a portion overlying the air intake aperture of the carburetor. The overlying portion of the reed is movable by flexing of the reed from a normal open position to a closed position in which it at least partially blocks the air intake aperture. The reed is tuned to vibrate at a frequency approximately equal to that of air intake pulses at selected maximum engine speed. As the engine speed approaches the selected maximum, the air intake pulses induce resonant vibration of the reed so as to bring the overlying portion intermittently into closed position. The air intake of the engine is thereby reduced so as to limit engine speed in part by providing a lesser charge and in part by increasing the fuel/air ratio to the point where engine power is reduced.

4 Claims, 2 Drawing Figures

SPEED LIMITING GOVERNOR FOR INTERNAL COMBUSTION ENGINE

FIELD OF INVENTION

The present invention relates to a governor for limiting the maximum speed of an internal combustion engine in particular a small, lightweight two stroke cycle engine of the kind used for chain saws and other portable power tools.

BACKGROUND OF THE INVENTION

In order to protect an internal combustion engine from the deleterious effects of running at excessive speed it is desirable automatically to limit the maximum speed at which the engine can be operated. The maximum operating speed is selected according to the construction and operating characteristics of the engine so as to provide a useful range of operating speed while protecting the engine from the excessive wear and destructive stresses incident to excessive speed. Over the years, many different devices have been proposed for limiting the speed of internal combustion engines. However, such devices have not been found to be entirely satisfactory. Among the disadvantages of prior devices are complexity of construction, excessive size and weight, unreliability in operation and variation in control speed due to wear or different operating conditions.

SUMMARY OF INVENTION

It is an object of the present invention to provide a speed governor for internal combustion engines and particularly two stroke cycle engines having the following desirable characteristics:

1. Simple construction;
2. Low cost;
3. Lightweight;
4. Small size, precise and easy calibration;
5. Easy to install and replace;
6. Avoidance of moving parts subject to wear;
7. Reliability in operation;
8. Uniformity of operation under different operating conditions;
9. Constant operating conditions throughout life;
10. Less fuel required at governing speed.

In accordance with the invention, the governor comprises a flexible reed having a portion overlying an aperture in an intake passage through which a gaseous charge is supplied to the engine at a periodically varying rate of flow having a frequency proportional to the engine speed. The overlying portion of the reed is movable by flexing of the reed from a normal open position to a closed position in which the overlying portion at least partially blocks the intake aperture so as to block or restrict flow therethrough. The reed is tuned to vibrate at a resonant frequency which is approximately equal to the frequency of variation of the rate of flow through the aperture at selected maximum engine speed. When the engine speed approaches the selected maximum, resonant vibration of the reed is induced by the periodically varying rate of flow. This results in the overlying portion of the reed intermittently at least partially blocking the intake aperture so as to restrict flow therethrough and thereby limit engine speed. From observations that have been made, it presently appears that engine speed is limited in part by providing a lesser charge and in part by increasing the fuel/air ratio so as to decrease engine power.

BRIEF DESCRIPTION OF DRAWINGS

The nature, objects and advantages of the invention will be more fully understood from the following description of a presently preferred embodiment shown by way of example in the accompanying drawings in which.

DESCRIPTION OF PREFERRED EMBODIMENT

Figure 1:
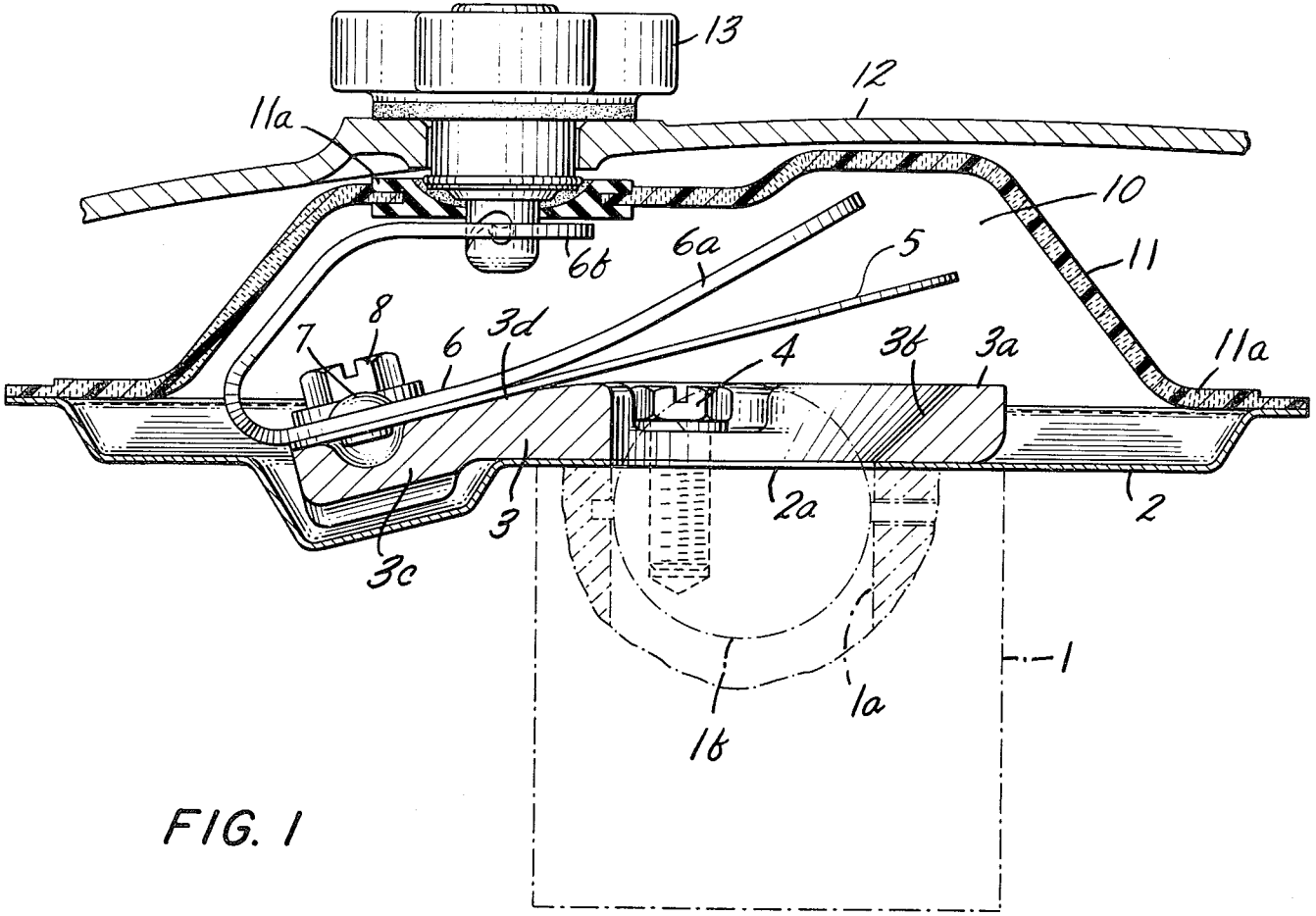
FIG. 1 is a sectional view of a governor in accordance with the present invention and associated engine parts including an air filter and cover.

There is shown by way of example in the drawings a governor for limiting the maximum speed of a lightweight, high performance two stroke cycle, single cylinder internal combustion engine of the kind used in chain saws and other hand held power tools. The engine has a carburetor 1 (shown schematically) having an intake passage 1*a* connected to the intake of the engine. A butterfly valve 1*b* in the intake passage may be either a throttle or a choke valve depending on the type and construction of the carburetor. In a two cycle engine the intake passage is customarily connected to the crankcase, the volume of which is variable by movement of the engine piston. When the piston moves from bottom dead center toward top dead center, the volume of the crankcase is increased so as to draw air into the intake passage 1*a*. Fuel is introduced into the intake passage by the carburetor so as to supply a fuel air mixture to the engine. During the downstroke of the engine piston, the fuel air mixture that has been drawn into the crankcase is compressed, the intake passage having been closed by suitable valve means. Near the end of the downstroke of the piston an exhaust port is opened to exhaust combustion products from the cylinder and also a transfer port is opened to connect the cylinder with the crankcase to permit the fuel air mixture to flow from the crankcase into the cylinder. By reason of this mode of operation of the engine, air is drawn into the intake passage 1*a* at a periodically varying rate of flow with a frequency proportional to engine speed.

Figure 2:
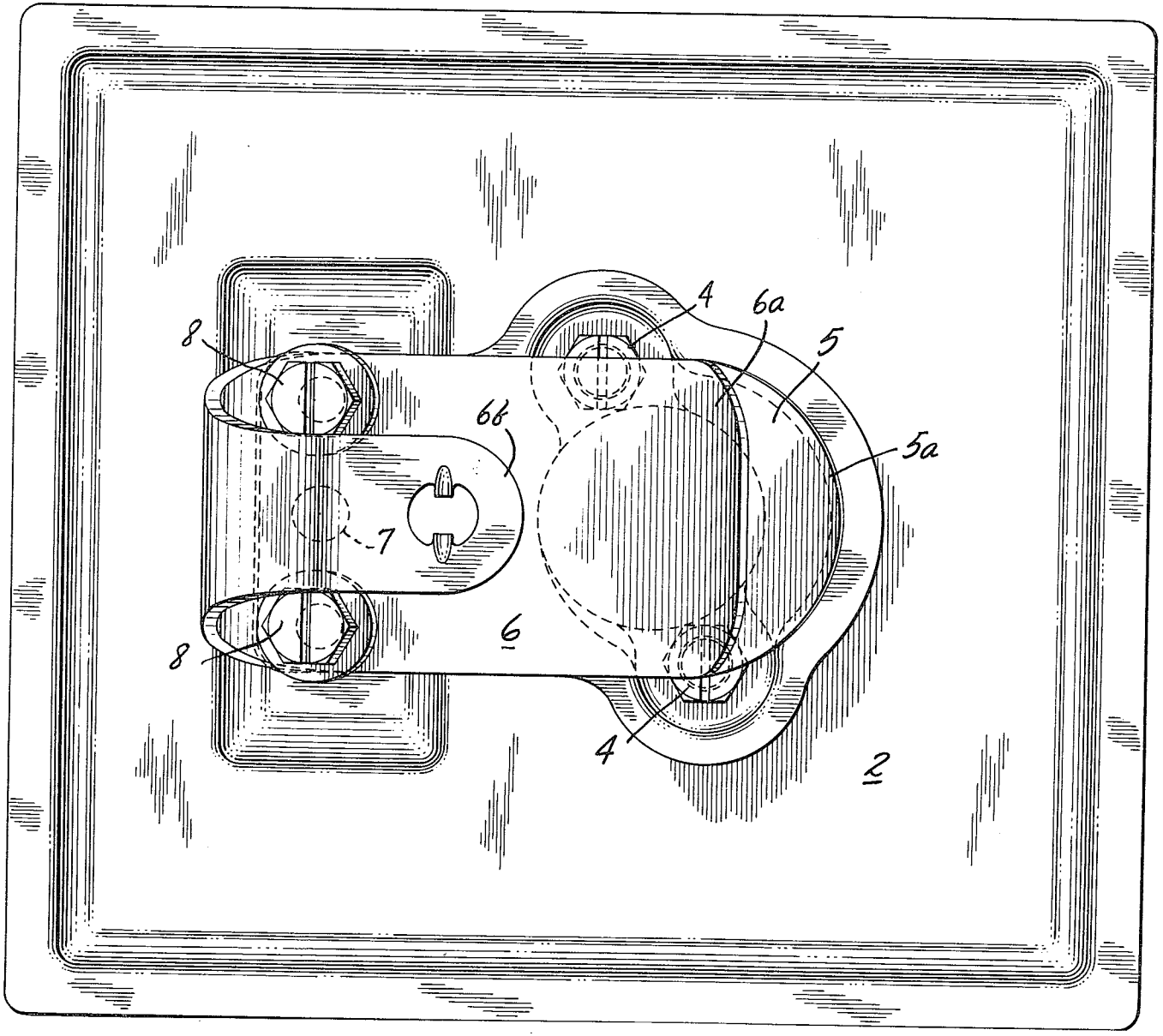
FIG. 2 is a plan with the filter and cover removed.

The carburetor 1 is suitably mounted in a carburetor chamber which is closed by a plate 2 having an opening 2*a* registering with the intake passage 1*a* so as to admit air to the carburetor. The carburetor chamber plate 2 is shaped to accommodate a governor base plate 3 which is mounted on the carburetor assembly by means of screws 4. The governor base plate 3 has a portion 3*a* which overlies the air intake passage of the carburetor and has an opening 3*b* in communication with the intake passage 1*a*. As will be seen in FIG. 1, the opening 3*b* is flared so as to provide a larger cross sectional area at its upstream end. The portion 3*a* of the governor base plate has a flat upper surface. A second portion 3*c* of the governor base plate 3 has an upper surface which is inclined to the upper surface of the portion 3*a*. The upper surfaces of the portions 3*a* and 3*c* are connected with one another by a smooth curve 3*d*. As shown by way of example in the drawings the upper surface of the portion 3*c* is inclined at an angle of about 15° to that of the portion 3*a*. A reed 5 of thin, flexible spring material is mounted on the base 3 by securing one end to the inclined portion 3*c* while the other end overlies but is normally spaced from the opening 3*b* in the other portion 3*a* of the base. In the construction shown by way of example in the drawings the reed is riveted to a reed stop 6 by a single rivet 7 and the reed stop and reed are then secured to the base by two screws 8. The left-hand end portion of the reed as viewed in FIG. 1 is thereby sandwiched between the reed stop and the base. As viewed in plan (FIG. 2), the reed is generally rectangular but the end 5*a* which overlies the opening 3*b* in the base 3 is rounded with a radius slightly greater than that of the opening. In relaxed static condition as viewed in side elevation (FIG. 1), the reed 5 is planar and hence disposed at an angle to the portion 3*a* of the base in which the opening 3*b* is located. In this position the reed does not materially restrict the flow of air into the intake passage. However, if the reed is flexed downwardly into the plane of the upper surface of the portion 3*a* of the base, it covers and substantially blocks the intake opening. Flexing of the reed 5 in the opposite direction is limited by the reed stop 6 which is curved to provide a portion 6*a* which overlies the free end portion of the reed and is disposed at an angle to the portion 3*a* of the base such that the reed lies approximately midway between the base and the reed stop when in relaxed static condition.

The geometry and material of the reed 5 are selected so that the resonant frequency of vibration of the reed is approximately equal to the frequency of the periodic variation of rate of flow of air through the intake passage when the engine is running at its selected maximum speed. By reason of this relationship the pulsed flow of the intake induces resonant vibration of the reed between the base 3 and the reed stop 6 when the engine approaches the selected maximum speed. When the reed is thus set in vibration it intermittently closes the opening 3*b* of the intake passage 1*a* and thereby restricts the supply of air to the carburetor. Restriction of the air intake results in reducing the charge supplied to the engine and also in increasing the fuel air ratio and thereby reducing power. The engine is thereby prevented from exceeding the selected maximum speed.

As illustrated in the drawings, the reed assembly is desirably located inside a chamber 10 defined by an air filter 11 which is dished and provided with a flange portion 11a seated on the carburetor chamber plate 2. The reed is thereby protected from disturbance by sawdust or dirt. The filter 11 and a cover 12 are removably held in place by a bayonet type fastening device 13, the inner end of which passes through a grommet 11a in the filter and engages in a suitably shaped opening in a tail end portion 6*b* of the reed stop 6 which is bent up so as to overlie the body portion of the reed stop.

The operation of the governor in accordance with the present invention will be readily understood from the foregoing description. When the engine is operating at idling speed or at normal operating speed, the reed 5 remains substantially stationary in the position shown in FIG. 1 and does not interfere with normal air intake of the engine. However, if the engine speed increases above normal operating speed and approaches a selected maximum speed, the reed 5 starts to vibrate so as intermittently to close the air intake opening and thereby restrict the air flow. This restriction prevents further increase in engine speed. If the engine speed is thereafter reduced, for example by applying load to the engine or reducing the throttle opening, the reed resumes its normal condition and ceases to restrict the air intake.

From the foregoing description it will be seen that the governor in accordance with the present invention is of simple and inexpensive construction and lightweight. No additional space is required for the governor since it is located in the air filter chamber. The governor is easily and precisely calibrated for the desired maximum engine speed by selection of the resonant frequency of the reed 5. Since there are no moving parts other than the flexing of the reed 5, the governor is not subject to wear and retains its calibration throughout its life. The governor is accessible for inspection merely by removing the cover 12 and filter 11 and can easily be installed, removed or replaced. In operation, the governor has been found to be accurate and reliable and moreover, less fuel is required at the same governing speed than with spring ball type governors. The governor in accordance with the present invention thus represents an important advance in the art.

While a preferred embodiment of the invention has been illustrated in the drawings and is herein particularly described, it will be understood that many modifications can be made and that the invention is in no way limited to the illustrated embodiment.

What I claim and desire to secure by letters patent is:

1. A governor for limiting the speed of an internal combustion engine having a carburetor for supplying a fuel-air mixture to the engine, the carburetor having an air intake passage with an aperture through which air is supplied to the carburetor at a periodically varying rate of flow having a frequency proportional to the speed of the engine, said governor comprising a flexible spring reed which is planar when in relaxed condition, and means mounting said reed on a support disposed at an angle to the plane of said aperture with a portion of said reed overlying the intake side of said aperture, said overlying portion of said reed being spaced from said aperture when the reed is in relaxed condition and being movable by flexing of said reed from a normal open position to a closed position in which said overlying portion at least partially blocks said aperture to restrict air flow therethrough, said reed being tuned to vibrate at a resonant frequency approximately equal to the frequency of variation of said rate of flow at a selected maximum engine speed, whereby vibration of said reed induced by said periodically varying rate of flow when the engine approaches the selected maximum speed results in said overlying portion of the reed intermittently at least partially blocking said aperture to restrict air flow therethrough so as to reduce the fuel-air supply to the engine and also to increase the fuel-air ration and thereby limit engine speed.

2. A governor according to claim 1, in which the support has a first flat portion in which said aperture is provided, a second flat portion located at one side of the aperture and a convex surface smoothly connecting the first and second flat surfaces, the reed being secured to the second flat surface.

3. A governor according to claim 2, further comprising a reed stop secured to said second flat surface and positioned to limit the amplitude of vibration of the reed.

4. A governor according to claim 3, in which an extension of the reed stop is bent back over said support and is provided with means for attaching an air filter.

* * * * *